United States Patent [19]

Lüdorf

[11] 4,368,450

[45] Jan. 11, 1983

[54] CONTACT ARRANGEMENT

[75] Inventor: Reiner Lüdorf, Gummersbach, Fed. Rep. of Germany

[73] Assignee: Starkstrom Gummersbach GmbH, Marienheide, Fed. Rep. of Germany

[21] Appl. No.: 321,894

[22] Filed: Nov. 16, 1981

[30] Foreign Application Priority Data

Nov. 28, 1980 [EP] European Pat. Off. ..... 801074485

[51] Int. Cl.[3] ..... H01H 37/52

[52] U.S. Cl. ..... 337/363; 337/378

[58] Field of Search ..... 337/362, 363, 378; 335/37, 121

[56] References Cited

FOREIGN PATENT DOCUMENTS 2242142 8/1972 Fed. Rep. of Germany ..... 337/378

567760 8/1975 Switzerland ..... 337/378

*Primary Examiner*—George Harris

*Attorney, Agent, or Firm*—Michael J. Striker

[57] ABSTRACT

A contact arrangement includes an elongated striker reciprocable in direction of its elongation and a pair of movable contacts moved by the striker and cooperating with adjacent stationary contacts so that during reciprocation of the striker between two end positions one of said movable contacts engages the stationary contact adjacent thereto while the other movable contact is spaced from the adjacent stationary contact, and vice versa.

In order to obtain during the reciprocation of the striker up to the moment of switching the contacts a high contact pressure, the striker is provided with a guide extending transverse to its reciprocation direction for a movable guide body. The movable guide body is mounted on one end of a link member the other end of which is articulately engaged with an angle lever in the region of the knee of the latter. A tension spring is connected at one end to the movable guide body and at the other end to one arm of the angle lever, the other arm of which is pivotally mounted on said support. A stationary guide body is coordinated with the movable guide body and the arrangement is made in such a manner that during the switching movement the movable guide body first moves in one direction along one face of the stationary guide body and then in the opposite direction along an opposite face of the stationary guide body.

11 Claims, 8 Drawing Figures

CONTACT ARRANGEMENT

BACKGROUND OF THE INVENTION

The present invention relates to a contact arrangement with an elongated striker movable in direction of its elongation and a pair of movable contacts actuated by the striker and cooperating with stationary contacts respectively adjacent to the movable contacts so as to move in one end position of the reciprocating striker one of the movable contacts into engagement with the stationary contact adjacent thereto and the other of the movable contacts out of engagement with the stationary contact adjacent thereto and, in the other end position of the striker, the one movable contact out of engagement with the stationary contact adjacent thereto and the other movable contact into engagement with the stationary contact adjacent thereto.

Contact arrangements of this kind are known in many different constructions and for many different uses. Relays and thermal overload switches may be mentioned as examples in which such contact arrangements are used. The contact arrangement according to the present invention may basically be used in all contact arrangements in which creeping or slow movement for actuating the contact arrangement may occur and in which nevertheless sudden switching is desired.

In contact arrangements of the prior art, the contact pressure between the engaging movable and stationary contacts depends on the actuating stroke or switching stroke, that is, the contact pressure decreases during this switching stroke until it reaches zero and only subsequently thereto is the switching carried out under opening of the contacts. This will result in essential disadvantages, especially in an unsafe contact and, in many operating conditions, in an insufficient safety against vibrations.

SUMMARY OF THE INVENTION

It is therefore an object of the present invention to provide a contact arrangement which will assure a reliable contact and which will not be disturbed by vibrations, especially during automatic or mechanical actuation.

These and other objects which will become apparent as the description proceeds are obtained according to the present invention in that the striker is provided with a guide extending transverse to the reciprocation of the striker for a movable guide body, that the movable guide body is mounted on a link member, that the link member articulately engages a bell crank in the region of the knee thereof, that between the movable guide body and one arm of the bell crank a tension spring is arranged, that the bell crank is tiltably mounted at its other arm, and that a stationary guide body is coordinated in such a manner with the movable guide body and the arrangement is made in such a manner that the movable guide body during the switching movement is guided in one direction along one side and in the other direction along the other side of the stationary guide body.

The main advantage of the present invention is that a high contact pressure is maintained during the actuating stroke or switching stroke up to immediately prior to the actual switching. This will result in a sure contact. Furthermore, the contact arrangement according to the present invention will not be disturbed by vibrations at any operating conditions, especially in case of automatic or mechanical actuation thereof. In this way, the contact arrangement according to the present invention can also be used as a contact arrangement operated at low electrical voltage, for instance 24 volts.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
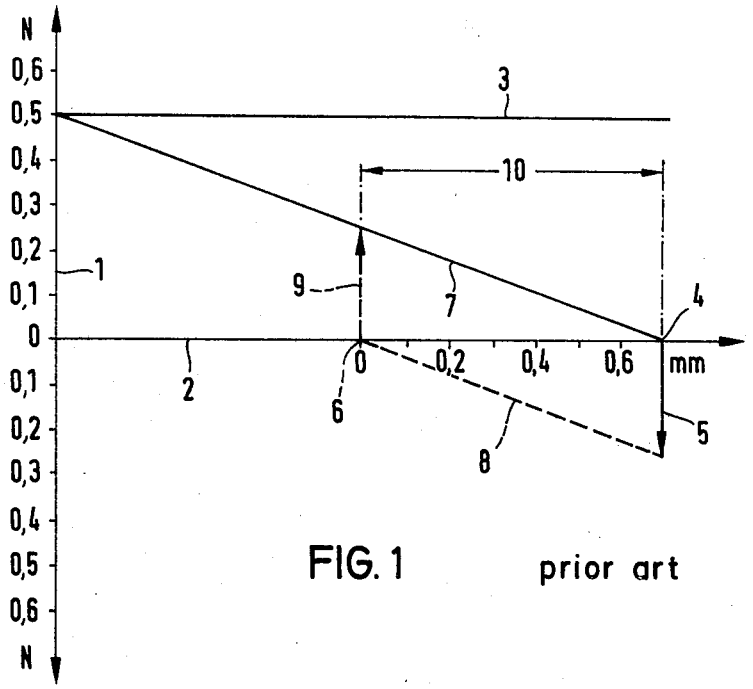
FIG. 1 prior art
FIG. 1 is a diagram illustrating the development of the contact pressure over the switching stroke at a contact arrangement according to the prior art.

FIG. 1 illustrates a development of the contact pressure during the switching stroke in a contact arrangement according to the prior art. Thereby the contact pressure is indicated in newtons on the vertical coordinate 1, whereas the switching stroke is indicated in millimeters on the horizontal coordinate 2. In a contact arrangement in cold condition, for instance in a cold relay, it is assumed that the contact pressure between one movable and one stationary contact member at the closed position of these contacts is 0.5 N, corresponding to the line 3 in FIG. 1. During operation of the relay, in which it is heated, this contact pressure drops to about half of this value. During the switching stroke, this contact pressure decreases corresponding to line 7 further and reaches, at a switching stroke of for instance 0.7 mm, at the switching point 4 the value of zero. The opening of the contact occurs therefore at an extremely small zero-approaching contact pressure. Assuming the relay has another movable and another stationary contact to form a closer while the first-mentioned two contacts open, then after the opening of the first-mentioned two contacts a contact pressure 5 of the closer is obtained. During the reversing switching stroke in accordance with line 8, the contact pressure 5 decreases also to the value zero at the return switching point 6 of the closer, while at the first-mentioned two contacts (opener) again a contact pressure 9 is obtained. These contact pressure variations are repeated during the to and fro movement switching stroke 10.

Figure 2:
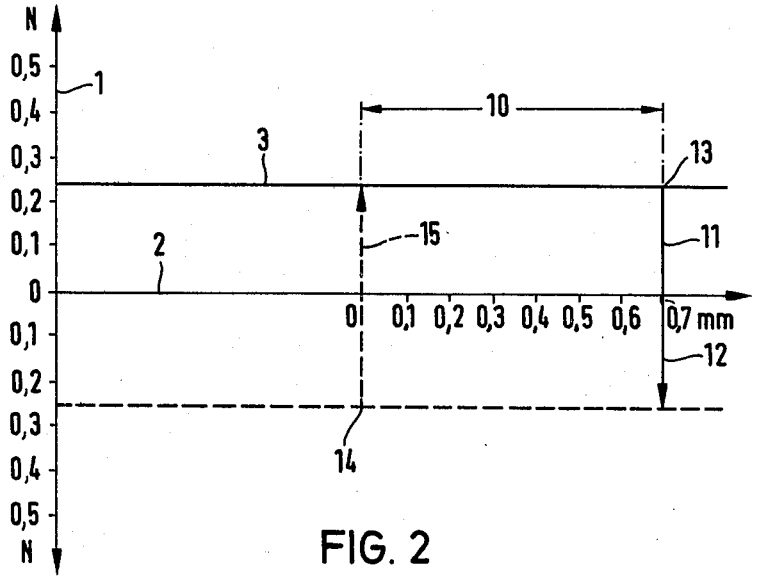
FIG. 2 is a diagram similar to FIG. 1 and illustrating the contact pressure over the switching stroke with a contact arrangement according to the present invention.

FIG. 2 illustrates the development of the contact pressure with a contact arrangement according to the present invention. As can be seen from the diagram of FIG. 2, the contact pressure indicated by the line 3 remains over the whole switching stroke 10 up to the switching 13 of the opener of the same value. After the switching, a contact pressure 12 of the closer is obtained, which corresponds to the contact pressure of the opener. During the reversing switching stroke, the contact pressure 12, indicated by the dotted line, remains also at the same value up to the switching point 14 and after the reverse switching there is again a contact pressure 15 of the opener obtained which corresponds to the contact pressure 11 at the switching point 13.

Figure 3:
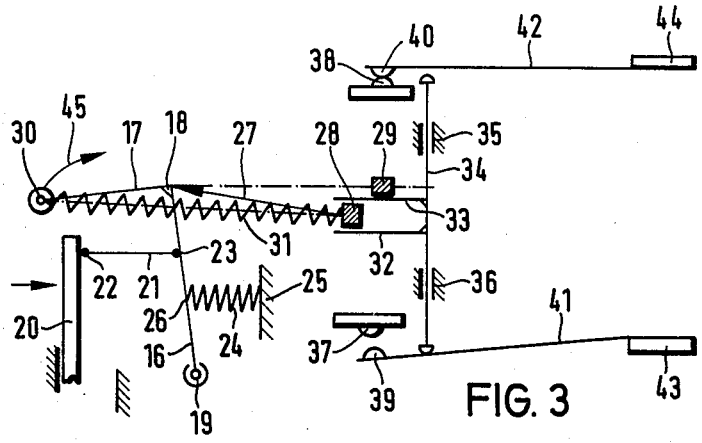
FIG. 3 is a schematic illustration of an embodiment of the contact arrangement according to the present invention in a starting position.

FIGS. 3–7 illustrates the construction principle of a contact arrangement according to the present invention. As can be seen from these Figures, the contact arrangement comprises an elongated striker 4 guided for reciprocation in direction of its elongation by guide means 35 and 36. The striker 34 serves for actuating movable contacts 39 and 40 which respectively cooperate with stationary contacts 37 and 38 in the position of these elements as shown in FIG. 3 the contacts 37, 39 form a closer and the contact 38, 40 an opener.

The striker 34 is provided with guide means 32, 33 extending transverse to the direction of the reciprocation thereof in which a movable guide body 28 is guided. This movable guide body 28, for instance in the form of a small block, is connected to one end of a link 27, the other end of which engages articulately in the region of the knee 18 of an angle lever or elbow. The angle lever essentially consists of two arms 17 and 16 enclosing an angle of substantially 90° and rigidly connected to each other in the region of 18. A tension spring 31 is provided connected at opposite ends respectively to the movable guide body 28 and the outer end 30 of the arm 17 of the angle lever. The angle lever is tiltably mounted at the outer end of the other arm 16 thereof in a stationary bearing for tilting movement about a tilting axis 19.

A stationary guide body 29 is coordinated in such a manner with the movable guide body 28 and the construction and arrangement of the above described elements is made in such a manner that the movable guide body 28, during the switching stroke in one direction, moves along one side and, during the switching stroke in the opposite direction, along the other side of the stationary guide body 29. It is to be understood that the movable guide body 28 extends with an end portion thereof beyond the guide 32, 33 and engages with this projecting end portion the stationary guide body on one or the other side thereof.

Figure 5:
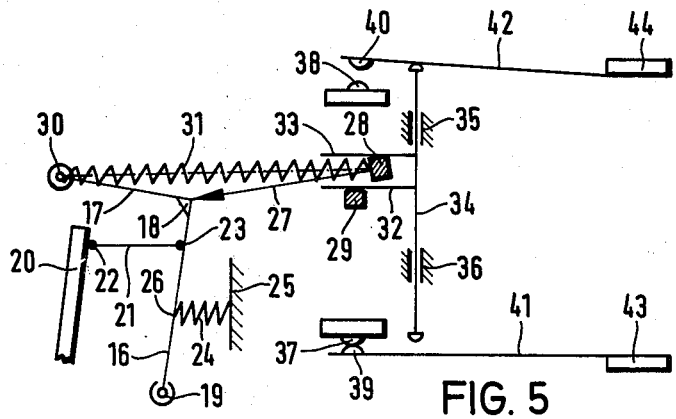
FIG. 5 shows the contact arrangement according to FIG. 3 in another operating position after switching.
Figure 7:
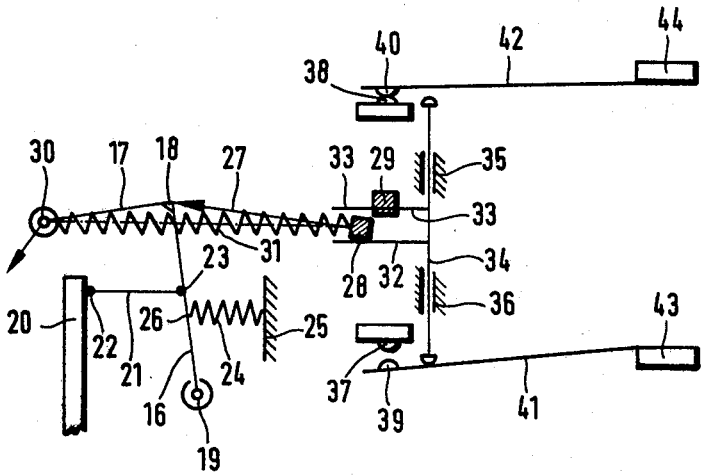
FIG. 7 illustrates the contact arrangement according to FIG. 3 in operating position after the return switching and thus shows the various elements in the same position as in FIG. 3.

The tension spring 31 is connected between the movable guide body 28 and the point 30 of the arm 17 of the angle lever in such a manner that the central axis of the tension spring 31 forms with the central axes of the arm 17 and the link 27 in the two end positions of the switching stroke according to FIGS. 3 and 7, on the one hand, and FIG. 5, on the other hand, substantially equal obtuse angled triangles.

An actuating lever 20 is connected to the angle lever, preferably to the arm 16 thereof, by means of a connecting member 21, the opposite ends 22 and 23 are pivoted to the actuating lever 20 and to the arm 16, respectively. A return spring 24 also engages the angle lever, and preferably also the arm 16 thereof, and the return spring is, depending on which side of the arm 16 it is arranged, either constructed as a compression spring or a tension spring. The return spring 24 is arranged between a stationary abutment 25 and the point 26 of the arm 16. The movable contacts 39 and 34 are connected to springs, preferably leaf springs 41 and 42, which in turn are fastened at the outer ends thereof in holders 43 and 44 provided with suitable connections for electrical conductors not shown in the drawings.

Figure 4:
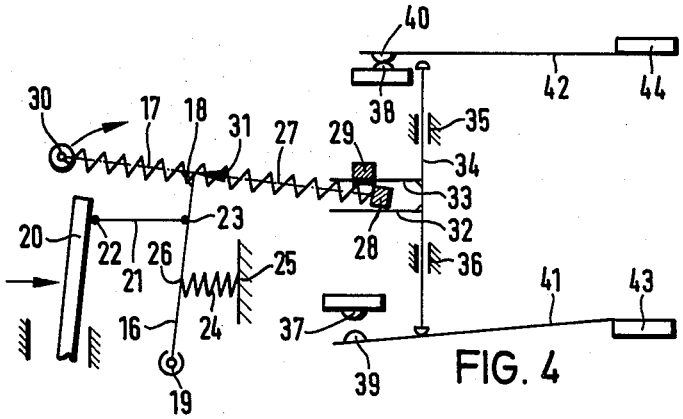
FIG. 4 illustrates the contact arrangement shown in FIG. 3 in an operating position prior to the switching.
Figure 6:
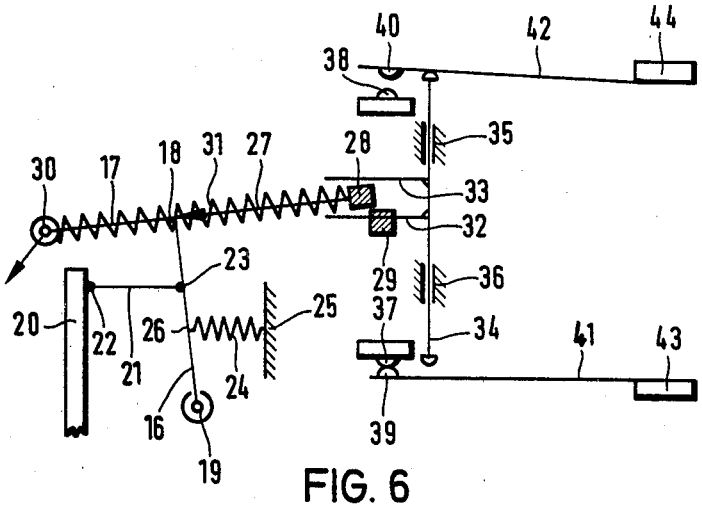
FIG. 6 shows the contact arrangement according to FIG. 3 in an intermediate operating position prior to return switching.

The operation of the above described contact arrangement is essentially as follows. Starting from the position of the various elements of the contact arrangement as shown in FIG. 3, it will be seen that in this starting position the pressure of the return spring 44 will tilt the angle lever with the arm 16 and 17, as well as the actuating lever 20 with the connecting element 21 and the link 27 with the movable guide body into the left end position, which is limited by an abutment. In this position, the tension springs 31 will extend below the knee 18 of the angle lever to produce thereby a force component parallel to the direction of movement of the striker 34, so that the movable guide body 28 in the guide 32, 33 will press the striker 34 in downward direction, so that the contact between the contact members 38, 40 will be closed and that between the contact members 37 and 39 opened. If now the actuating lever 20 is pressed in the direction of the arrow adjacent thereto towards the right, as viewed in the drawing, then the angle lever will be tilted in clockwise direction about the tilting axis 19, and the connecting points 30 of the tension springs 31 will move in the direction of the arrow 45 upwardly. The return spring 24, assuming it is a compression spring to the right side of the arm 16 as shown in the drawing, will be compressed, and the movable guide body 28 slide with a portion thereof which projects normal to the drawing plane beyond the guide 32, 33 along the bottom face of the stationary guide body 29, which is arranged laterally of the guide 32, 33 so as not to prevent movement of the same with the striker 34. During the sliding of the movable guide body 28 on the stationary guide body 29 a premature switching cannot occur, and the contact pressure exerted by the leaf spring 42 between the contact members 38 and 40 is maintained constant. Due to the tilting movement of the angle lever about the tilting axis 19, the tension spring 31 will finally reach a position which goes beyond the middle position as shown in FIG. 4, that is the tension spring will extend above the knee 18 of the angle lever. This will result in opposite force component, that is a force component in upward direction, which however can act only after the movable guide body 28 is moved toward the right to such an extent that it will be received from the stationary guide body 28. At this moment, a sudden switching will occur, that is an opening of the contact members 38, 40 and a closing of the contact members 37, 39. The striker 34 has there removed upwardly as shown in FIG. 5. If now the actuating lever 20 is released, then the return spring 24 will tilt the angle lever in counterclockwise direction back to its starting position, whereby the movable guide body 28 will slide along the upper surface of the stationary guide body 29 until a middle position as shown in FIG. 6 is surpassed so that again a force component in downward direction will result, and the movable guide body 28 together with the guide 32, 33 and the striker 34 under the action of the tension spring 31 suddenly are brought to the position as shown in FIG. 7. Thereby the starting position according to FIG. 3 is again obtained. In this connection it is again mentioned that the switching stroke shown in FIG. 2 is proportioned to the length of the movement of the movable guide body 28 in the guide 32, 33. It is further to be understood that the reciprocation of the slider 34 is limited by non-illustrated abutment.

Figure 8:
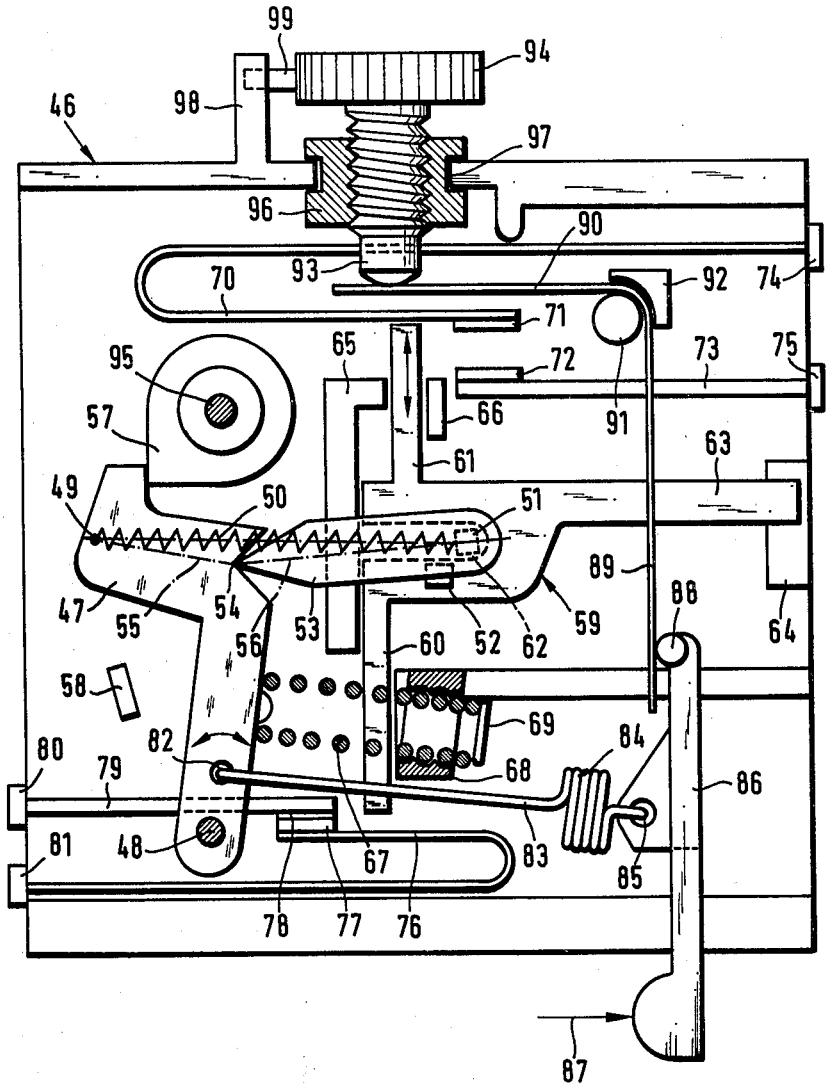
FIG. 8 is a partly sectioned side view schematically illustrating an actual embodiment according to the present invention on a rather enlarged scale.

The somehow schematically illustrated embodiment of a contact arrangement according to the present invention illustrated in FIG. 8 is based on the same principle, which was discussed in connection with FIGS. 3–7. An angle lever 47 with two arms extending substantially at a right angle with respect to each other is tiltable about a tilting axis 84 mounted in a housing 46 which may be closed by a cover not shown in this drawing. A tension spring 50 is connected at one end at a point 49 to the angle lever 47 and, on the other hand, on the movable guide body 51. The movable guide body 51 is guided in a guide 62 which extends transverse to the direction of movement of the striker 59. It is to be understood that the movable guide body 51 projects with its end portion beyond the guide 62 and cooperates with this projecting portion with a stationary guide body 52. The link 53 engages with its left end, as viewed in FIG. 4, in a vearing 54 which may for instance be constructed as a V-shaped notch. The striker 59 is provided with a downwardly extending arm 60 which cooperates with a U-shaped bent leaf spring 76 carrying the movable contact member 77. An upwardly extending arm 61 of the striker cooperates correspondingly with the U-shaped bent leaf spring 70 carrying the movable contact member 71. The striker 59 may also be provided with an elongated portion 63 extending transverse to the direction of movement of the striker, and the elongation 63 may for instance reach into a window 64 provided in the housing 46 so that the respective operating position of the contact arrangement may be viewed from the outside.

The operating position shown in FIG. 4 corresponds to that in FIG. 5, that is the central axis of the tension spring 50 forms with the central axis 55 of one arm of the angle lever 47 and with the central axis 56 of the link 53 an obtuse angled triangle. The tilting of the angle lever 47 is limited by the abutments 57 and 58, whereby the abutment 57 is held on a bolt 95.

The striker 59 is guided for movement in longitudinal direction at opposite sides by the guide members 55 and 56. A return spring 67 abuts again on the angle lever 47. The end of the return spring 67 opposite from the end which engages the angle lever 47 is preferably adjustably located in a helical groove provided at the inner surface of an annular return spring holder 68. The helical groove is thereby advantageously formed in accordance with the cross section of the turns of the return spring. The spring end 69 is bent over so that it will extend diagonally with respect to the last spring turn. Thereby it is possible to adjust the pressure of the return spring 67 by turning the latter by engaging the bent over spring end with a suitable tool.

Stationary contact members 72 and 78 are again arranged opposite the movable contact members 71 and 72. The stationary contact members 72 and 78 are carried by rigid electrically conductive bars 73 and 79, respectively, and the outer ends of these bars are respectively connected to connecting members 75 and 78 of standard construction for connecting electrical conductors not shown in the drawings. The outer ends of the U-shaped leaf springs 70 and 76 are likewise provided at the outer ends with current connectors.

An actuating lever 86 is again connected as described in connection with FIGS. 3 and 7 by means of a connecting member 83 to the angle lever 47 and the connecting member 83 is pivotally connected to the actuating lever 86 at the point 85 and pivotally connected with the angle lever 47 at the point 82. A portion of the connecting member 83 is preferably a spring 84 integrally formed with the connecting member and the spring is in the illustrated embodiment constructed as a tension spring, which will damp the transmitted switching forces.

The embodiment according to FIG. 8 is further provided with a compensation bimetallic strip 89, 90 which cooperates with the actuating lever 86. This compensation bimetallic strip is preferably intermediate its ends bent at a substantially 90° angle and at its bent portion tiltably held in holding means. These holding means may be formed by a cylindrical trunnion 91 and an opposite member 92 having a curved surface directed towards the trunnion 91 to form between these two elements a slot in which the bent portion of the bimetallic strip is arranged. The bimetallic strip abuts with its leg 89 on the end 88 of the actuating lever 86 and with its other leg 90 onto an adjusting device which, for instance, may be constituted by a screw bolt 93 which abuts with its lower end against the leg 90 and it integrally carries at its upper end an adjustment wheel 94. The bimetallic strip together with the adjusting device permits a fine adjustment of the position of the actuating lever 86 for automatic or mechanical operation of the contact arrangement. As can be visualized from FIG. 8, a downward screwing of the screw bolt 93 will tilt the leg 89 of the bimetallic strip towards the right, as viewed in FIG. 8 and therewith produce a tilting movement of the actuating lever about the point 85 so that the lower end of the actuating lever 86 will move closer to a non-illustrated actuating element acting in the direction of the arrow 87, so that the switching will occur earlier, whereas at the reverse control of the adjusting device a later switching will occur.

The screw bolt 93 is threadingly engaged with the internal thread of a nut 96 which is mounted turnable but axially immovable in a seat 97 of the housing 46. The housing 46 is further provided with a stationary abutment 98 leading up to the height of the adjusting lever 94. A lateral projection 99 integrally connected with the adjusting lever 94 cooperates with the abutment 98. The adjusting device will operate as follows. The adjusting wheel is first turned until the projection 99 thereon abuts against the abutment 98. Subsequently thereto, the adjusting wheel 94 together with the bolt 93 is moved by turning the nut 96 in downward direction into engagement with the leg 90 of the bimetal strip. When the later reaches the desired position, the nut 96 is fixed to the housing 46 by any suitable means, for instance by cementing or welding.

It will be understood that each of the elements described above, or two or more together, may also find a useful application in other types of contact arrangements differing from the types described above.

While the invention has been illustrated and described as embodied in a contact arrangement in which opening or closing of the contact is carried out suddenly and in which a constant contact pressure on the contacts will be obtained up to the point of actually opening the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A contact arrangement comprising support means, a first stationary contact member mounted on said support means; a second stationary contact member mounted on said support means spaced in one direction from said first stationary contact member; a first movable contact member arranged adjacent said first stationary contact member; a second movable contact member arranged adjacent said second stationary contact member; elongated striker means guided for reciprocating movement in a direction of its elongation to move during its reciprocation in one direction one of the movable contact members in engagement with the stationary contact member adjacent thereto and the other movable contact member out of engagement with the stationary contact member adjacent thereto, and vice versa; guide means provided on said striker means extending transverse to the reciprocation direction of said striker means; a movable guide body mounted in said guide means for movement in said transverse direction; and an angle lever transversely spaced from said striker means and having one arm pivotally mounted in the region of its free end on said support means and another arm extending transverse to said one arm and integrally joined to the latter by a knee; a link member carrying in the region of one end said movable guide body and articulately engaging with its other end said angle lever in the region of said knee; a tension spring connected at one end to said movable guide body and at the other end to said other arm of said angle lever; a second guide body having two opposite faces extending in said transverse direction, said second guide body being mounted in stationary position on said support means and being coordinated with said movable guide body and said guide means thereof so that during movement of said striker means said movable guide body will first be moved in one direction along one of said opposite faces of said stationary guide body and then in an opposite direction along the other of said opposite faces of said stationary guide body.

2. A contact arrangement as defined in claim 1, wherein said striker means is movable between two end positions and in which said tension spring is arranged between said movable guide body and the other arm of said angle lever so that a central axis of said tension spring forms with the central axis of said upper arm and that of said link at both end positions of said striker body obtuse angle triangles of substantially equal size.

3. A contact arrangement as defined in claim 1, and including an operating lever and a connecting member connecting said operating lever to said angle lever.

4. A contact arrangement as defined in claim 1, and including spaced abutment means on said support means for limiting pivotal movement of said angle lever.

5. A contact arrangement as defined in claim 3, wherein said connecting member includes a resilient portion.

6. A contact arrangement as defined in claim 1, and including a return spring acting on said angle lever.

7. A contact arrangement as defined in claim 6, wherein said return spring is a coiled compression spring engaging with one end said angle lever and including an annular return spring holder mounted on said support means and provided with an interior helical groove in which coils at the other end of said return spring are adjustably mounted.

8. A contact arrangement as defined in claim 1, further including two leaf springs each mounted at one end on said support means and carrying at the other end thereof respective ones of said movable contacts.

9. A contact arrangement as defined in claim 3, and including compensation means in form of an elongated bimetallic strip cooperating with said operating lever.

10. A contact arrangement as defined in claim 9, wherein said elongated bimetallic strip extends intermediate its ends to form two legs substantially normal to each other, and including holding means mounted on said support means for tiltably holding said bent bimetallic strip intermediate its ends, one leg of said bimetallic strip engaging said operating lever, and including adjustment means mounted on said support means and engaging the other leg of said bimetallic strip.

11. A contact arrangement as defined in claim 10, wherein said adjusting means comprises a screw bolt engaging with one end said other leg of said bimetallic strip in the region of said free end thereof, an adjustment wheel coaxially fixed to the other end of said screw bolt and provided with a lateral projection, an abutment on said support means arranged for engagement with said lateral projection and a nut mounted on said support means turnable about its axis but immovable in axial direction into which said screw bolt is screwed.

* * * * *